US008089334B2

(12) United States Patent
Ritter et al.

(10) Patent No.: US 8,089,334 B2
(45) Date of Patent: Jan. 3, 2012

(54) CAST-COIL INDUCTOR

(75) Inventors: Allen Michael Ritter, Roanoke, VA (US); Robert Gregory Wagoner, Roanoke, VA (US); John Harold Parslow, Scotia, NY (US); Abdelgelil Amer, Saratoga Springs, NY (US)

(73) Assignee: General Electric Company, Schenectady, NY (US)

( * ) Notice: Subject to any disclaimer, the term of this patent is extended or adjusted under 35 U.S.C. 154(b) by 220 days.

(21) Appl. No.: 12/366,534

(22) Filed: Feb. 5, 2009

(65) Prior Publication Data

US 2010/0194518 A1 Aug. 5, 2010

(51) Int. Cl.
*H01F 27/24* (2006.01)

(52) U.S. Cl. ..... 336/213; 336/212; 336/216; 336/221; 336/198

(58) Field of Classification Search ..... 336/199, 336/205, 213, 212, 216, 221, 198
See application file for complete search history.

(56) References Cited

U.S. PATENT DOCUMENTS

| | | | | | |
|---|---|---|---|---|---|
| 2,856,639 | A | * | 10/1958 | Forrest et al. | 264/272.19 |
| 3,774,298 | A | * | 11/1973 | Eley | 29/605 |
| 4,032,874 | A | | 6/1977 | Kudlacik et al. | |
| 4,804,340 | A | * | 2/1989 | Hamer et al. | 439/709 |
| 5,028,904 | A | * | 7/1991 | Kurano | 336/96 |
| 5,271,373 | A | * | 12/1993 | Takaishi et al. | 123/634 |
| 5,285,760 | A | * | 2/1994 | Takaishi et al. | 123/634 |
| 5,477,203 | A | * | 12/1995 | Sawazaki et al. | 336/92 |
| 5,587,694 | A | | 12/1996 | Minato et al. | |
| 5,615,659 | A | * | 4/1997 | Morita et al. | 123/634 |
| 6,633,168 | B2 | * | 10/2003 | Hopkinson et al. | 324/547 |
| 6,717,504 | B2 | * | 4/2004 | Fujiwara et al. | 336/233 |
| 6,771,157 | B2 | * | 8/2004 | Nishikawa et al. | 336/178 |
| 6,873,239 | B2 | | 3/2005 | Decristofaro et al. | |
| 6,900,998 | B2 | | 5/2005 | Erickson et al. | |
| 6,906,608 | B2 | * | 6/2005 | Fujiwara et al. | 336/110 |
| 7,071,579 | B2 | | 7/2006 | Erdman et al. | |
| 7,136,293 | B2 | * | 11/2006 | Petkov et al. | 363/126 |
| 7,324,360 | B2 | | 1/2008 | Ritter et al. | |
| 7,353,587 | B2 | | 4/2008 | Vinciarelli et al. | |
| 2004/0207503 | A1 | | 10/2004 | Flanders et al. | |
| 2006/0250207 | A1 | | 11/2006 | Shudarek | |
| 2007/0024059 | A1 | | 2/2007 | D'Atre et al. | |
| 2007/0080769 | A1 | | 4/2007 | Thiel et al. | |

* cited by examiner

*Primary Examiner* — Anh Mai
*Assistant Examiner* — Joselito Baisa
(74) *Attorney, Agent, or Firm* — James McGinness, Esq.; Armstrong Teasdale LLP

(57) ABSTRACT

An inductor device is described. The inductor device includes a core comprising two core sections, at least one gap defined between the two core sections, and at least one cast coil and fringe shield assembly. The at least one cast coil and fringe shield assembly includes a conductor winding and a fringe shield sealed within an insulator. The at least one cast coil and fringe shield assembly is configured to at least partially surround portions of the two core sections.

19 Claims, 8 Drawing Sheets

CAST-COIL INDUCTOR

BACKGROUND OF THE INVENTION

The field of the invention relates generally to inductors for use in electrical equipment, and more specifically to inductors that include a cast coil and a fringe shield.

Inductors, also referred to as reactors in some applications, may be used in connection with dynamoelectric machines. For example, an inductor may be used in a variable speed wind turbine. A wind turbine uses the wind to generate electricity. A wind turbine typically includes a nacelle that houses an electric generator. The wind turbine also typically includes a rotor that includes a plurality of rotor blades attached to a rotating hub. The rotor is coupled to the electric generator, wherein the wind turbine rotor converts wind energy into rotational energy that is used to rotate the rotor of the electric generator. Variable speed operation of the wind turbine facilitates enhanced capture of energy by the turbine when compared to a constant speed operation of the turbine. However, variable speed operation of the wind turbine produces electricity having varying voltage and/or frequency. More specifically, the frequency of the electricity generated by the variable speed wind turbine is proportional to the speed of rotation of the rotor. A power converter may be coupled between the electric generator and a utility grid. The power converter outputs a fixed voltage and frequency electricity for delivery on the utility grid.

Some known power converters include semiconductor switches capable of handling high currents and voltages. However, the semiconductor switches may not be able to operate at high frequencies due to thermal limitations. To overcome the thermal limitations, a filter may be coupled to the output of the semiconductor switches to filter harmonic content from the electricity. Such filtering adds to the cost, and may adversely impact the efficiency of the power converters.

A power converter that includes multiple threads may facilitate high power and/or high frequency power conditioning without a filter, by producing a low level of harmonic content. In some examples, a power converter that includes multiple threads is coupled to multiple inductors, for example, differential mode inductors and/or common mode inductors. A power converter of this type facilitates cost-savings by eliminating the need for the filter.

BRIEF DESCRIPTION OF THE INVENTION

In one aspect, an inductor device is provided. The inductor device includes a core comprising two core sections, at least one gap defined between the two core sections, and at least one cast coil and fringe shield assembly. The at least one cast coil and fringe shield assembly includes a conductor winding and a fringe shield sealed within an insulator. The at least one cast coil and fringe shield assembly is configured to at least partially surround portions of the two core sections.

In another aspect, a cast coil and fringe shield assembly is provided. The cast coil and fringe shield assembly includes a conductor winding configured to surround an inductor core section and a fringe shield positioned adjacent the conductor winding. The fringe shield and the conductor winding are molded within an insulating material.

In yet another aspect, a method for manufacturing a cast coil and fringe shield assembly is provided. The cast coil and fringe shield assembly is configured to be positioned within an inductor comprising at least one cast core and fringe assembly and an inductor core. The method includes winding a conductor to form a conductor winding that includes an opening dimensioned to substantially match dimensions of a portion of the inductor core. The method also includes positioning the conductor winding and a fringe shield in a molding cavity and filling the molding cavity with an insulating material configured to insulate the conductor winding and maintain the position of the fringe shield with respect to the conductor winding.

DETAILED DESCRIPTION OF THE INVENTION

Various embodiments of the present invention include a wind turbine system, and more particularly, an inductor for use in a wind turbine system that includes a cast coil and fringe shield assembly. Technical effects of the various embodiments include positioning and stabilization of a fringe shield with respect to a conductor winding. Other technical effects include accurate positioning of a gapping material within the cast coil and fringe shield assembly with respect to the conductor winding and the fringe shield, as well as a reduction in a number of individual parts included in the inductor.

Figure 1:
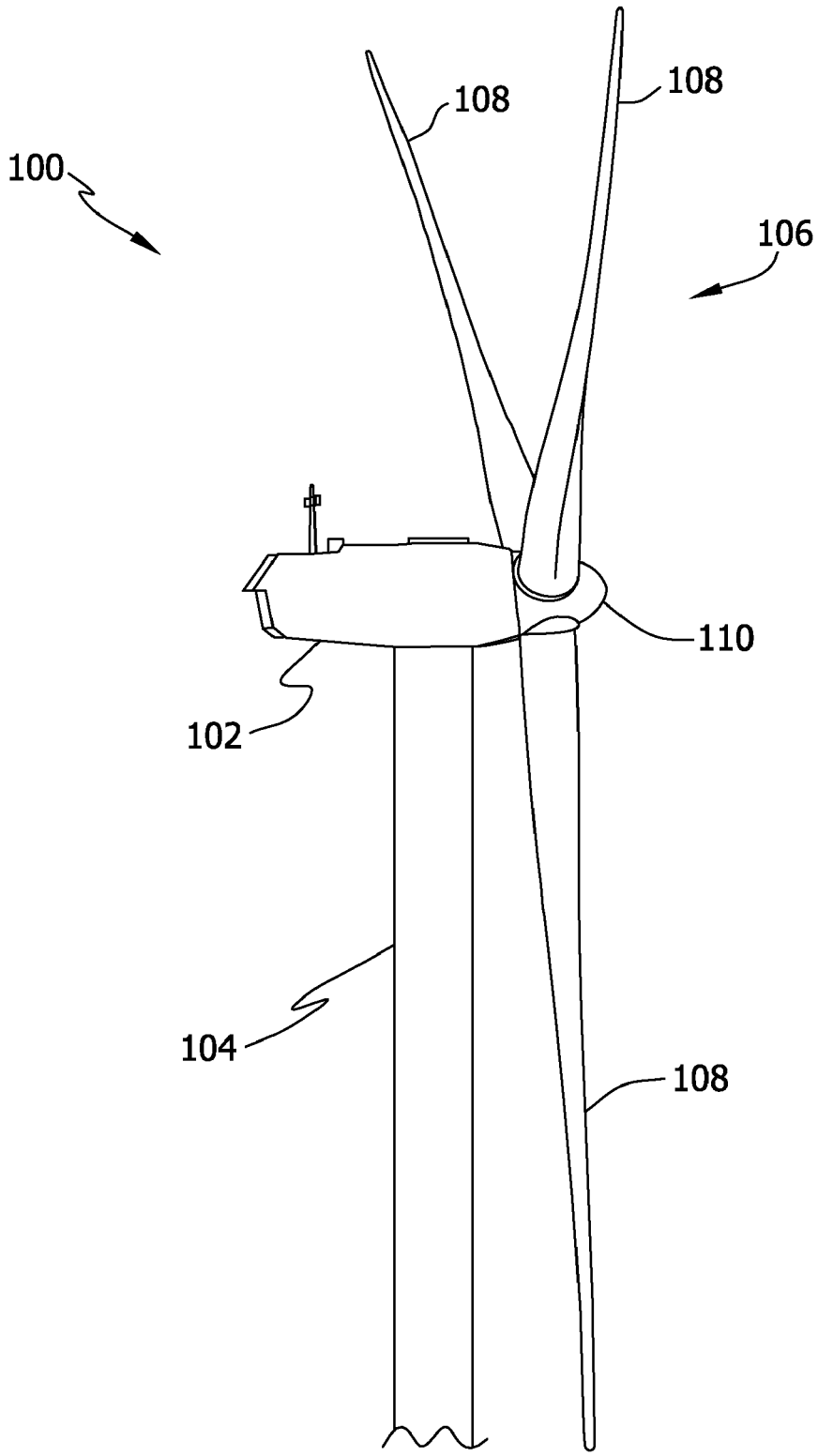
FIG. 1 is a side perspective view of an exemplary embodiment of a wind turbine.

FIG. 1 is a side perspective view of an exemplary embodiment of a wind turbine 100. Wind turbine 100 generally includes a nacelle 102 housing a generator (not shown in FIG. 1). Nacelle 102 is mounted on a tower 104, a portion of which is shown in FIG. 1. Wind turbine 100 also includes a rotor 106 that includes a plurality of rotor blades 108 attached to a rotating hub 110. Although the wind turbine 100 illustrated in FIG. 1 includes three rotor blades 108, there are no specific limits on the number of rotor blades 108 required by various embodiments of the present invention. Thus, additional or fewer rotor blades 108 may be provided.

Figure 2:
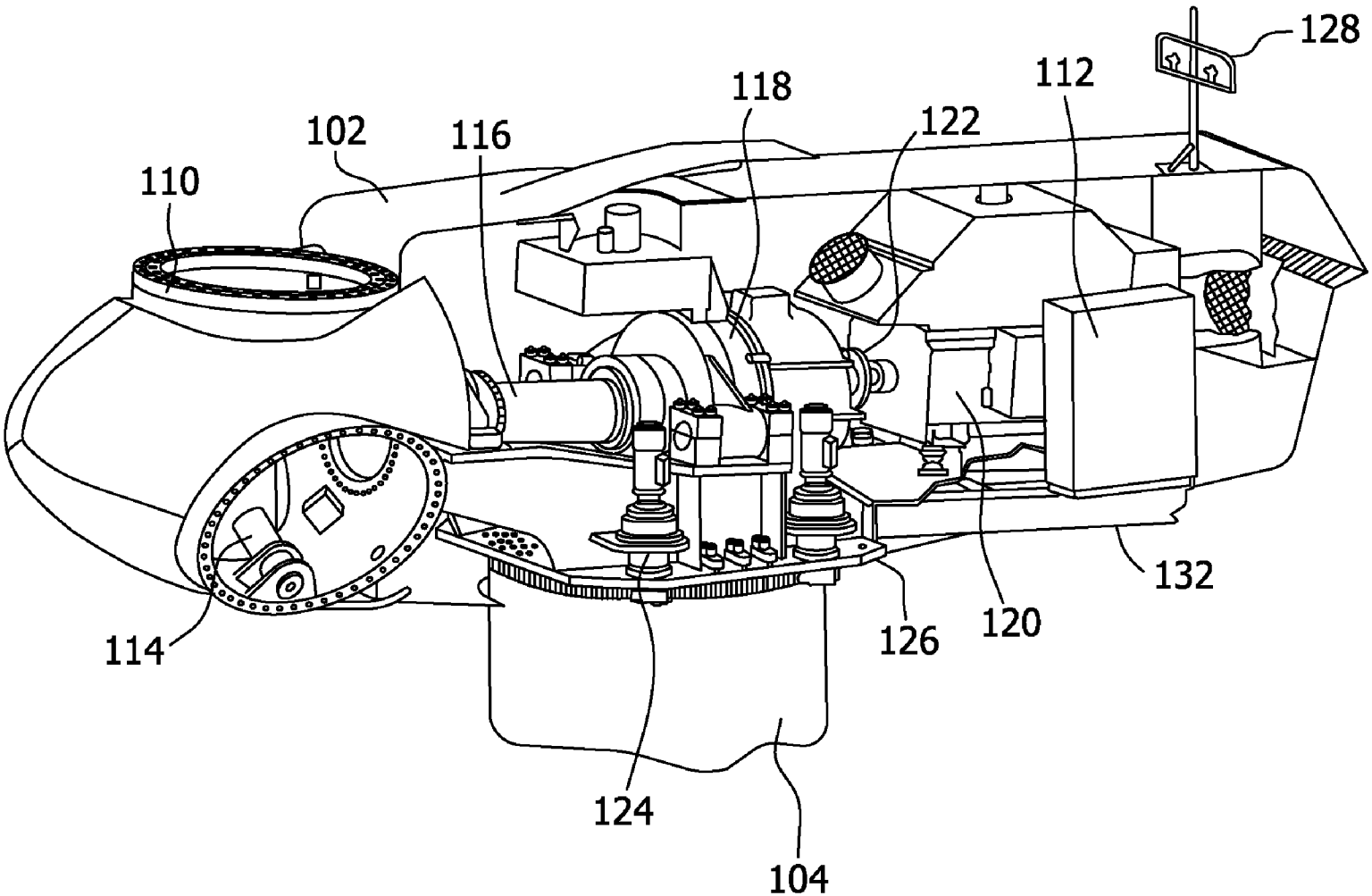
FIG. 2 is a cut-away perspective view of a nacelle of the exemplary wind turbine shown in FIG. 1.

FIG. 2 is a cut-away side perspective view of nacelle 102 (shown in FIG. 1). In the exemplary embodiment, various components are housed in nacelle 102 on tower 104 of wind turbine 100. Further, a height of tower 104 may be selected based upon factors and conditions known in the art. In some embodiments, one or more microcontrollers (not shown in FIG. 2) within a control panel 112 form a control system used for overall system monitoring and control including pitch and speed regulation, high-speed shaft and yaw brake application, yaw and pump motor application, and power level and fault monitoring. Alternative distributed or centralized control architectures may be used in some embodiments.

In various embodiments, the control system provides control signals to a variable blade pitch drive 114 to control the pitch of blades 108 (shown in FIG. 1) that drive hub 110 as a result of wind. Hub 110 and blades 108 together form wind turbine rotor 106 (shown in FIG. 1). The drive train of the wind turbine includes a main rotor shaft 116 (also referred to as a "low speed shaft") connected to the hub 110 and a gear box 118 that, in some embodiments, utilizes a dual path geometry to drive a high speed shaft enclosed within the gear box 118. The high speed shaft (not shown in FIG. 2) is used to drive a generator 120 that is supported by a main frame 132. In some embodiments, rotor torque is transmitted via a coupling 122. Generator 120 may be of any suitable type, for example and without limitation, a wound rotor induction generator, such as a doubly fed induction generator. Another suitable type by way of non-limiting example is a multi-pole generator that can operate at the speed of the low speed shaft in a direct drive configuration, without requiring a gearbox.

A yaw drive 124 and a yaw deck 126 provide a yaw orientation system for wind turbine 100. In some embodiments, the yaw orientation system is electrically operated and controlled by the control system in accordance with information received from sensors used to measure shaft flange displacement, as described below. Either alternately or in addition to the flange displacement measuring sensors, some configurations utilize a wind vane 128 to provide information for the yaw orientation system. The yaw system is mounted on a flange provided atop tower 104.

Figure 3:
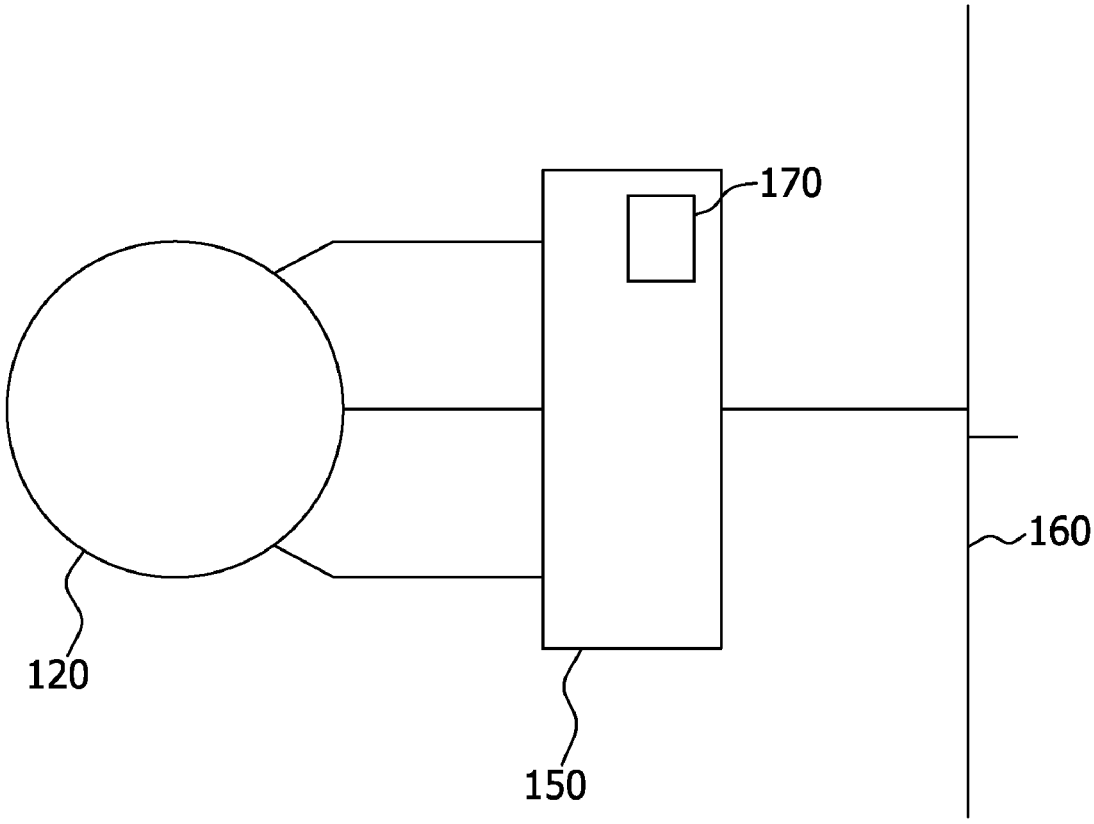
FIG. 3 is a block diagram of a generator, a power converter, and a power grid.

FIG. 3 is a block diagram of generator 120 (shown in FIG. 2), a power converter 150, and a power grid 160. In the exemplary embodiment, generator 120 is a component within a variable speed wind turbine, for example, variable speed wind turbine 100 (shown in FIG. 1). Power converter 150 is configured to condition a variable frequency and/or variable voltage power produced by generator 120 for distribution on power grid 160. In the exemplary embodiment, power converter 150 includes at least one inductor 170. Inductor 170 allows voltage distortion created by a power supply to produce limited current distortion when connected to a distortion free voltage node.

Figure 4:
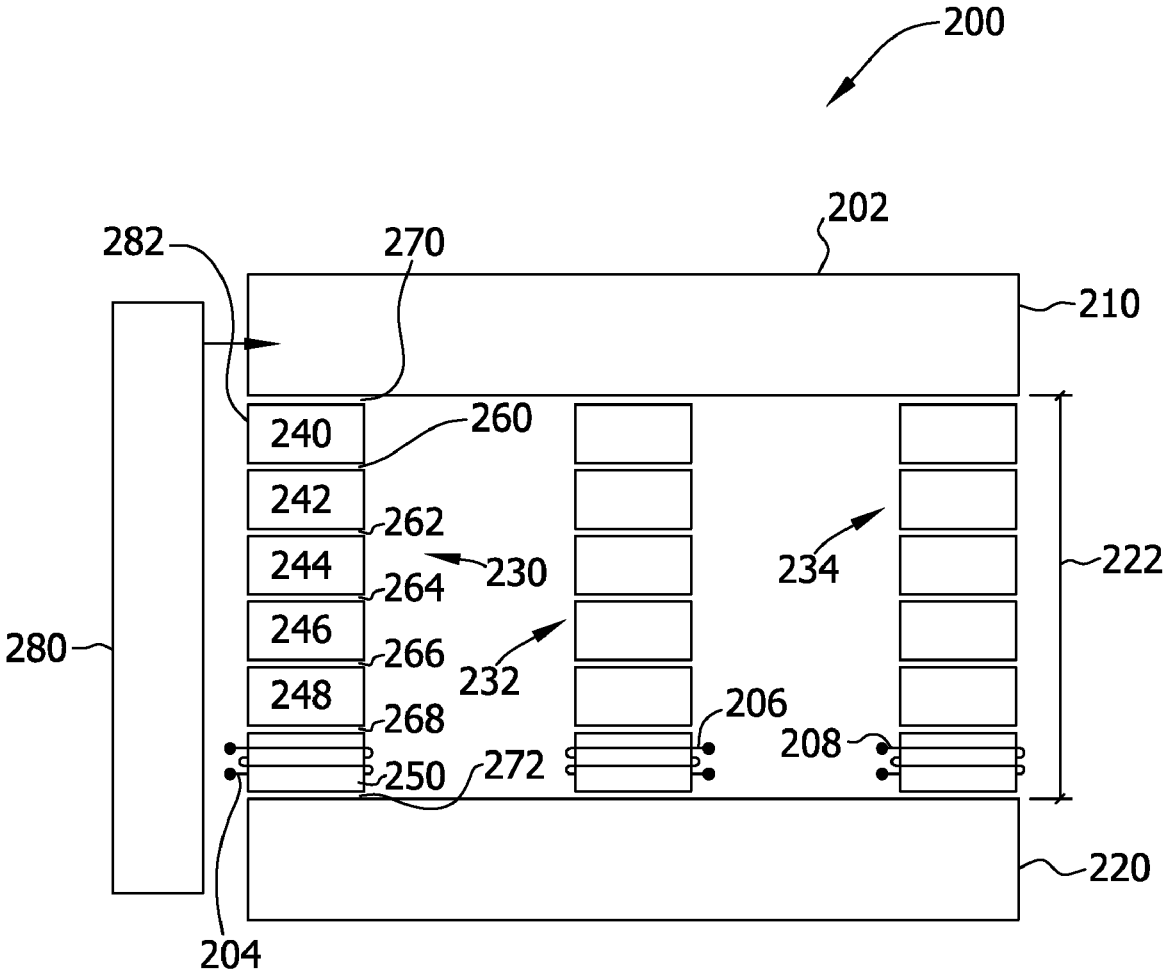
FIG. 4 PRIOR ART
FIG. 4 is a side view of a known inductor, which may be included within the power converter shown in FIG. 3.

FIG. 4 is a side view of a known inductor 200, which may be included within power converter 150 (shown in FIG. 3). In some embodiments, inductor 200 is approximately thirty inches by thirty inches by thirty inches. However, inductor 200 may be any size that allows power converter 150 to function as described herein. Inductor 200 includes a core 202 and a plurality of conductor windings, for example, conductor windings 204, 206, and 208. Core 202 includes a first frame section 210 and a second frame section 220. In at least some embodiments, first and second frame sections 210 and 220 include a plurality of laminations (not shown in FIG. 4) assembled to form first and second frame sections 210 and 220. First frame section 210 is positioned a predetermined distance 222 from second frame section 220, and is substantially parallel to second frame section 220. Core 202 also includes a first leg 230, a second leg 232, and a third leg 234. First, second, and third legs 230, 232, and 234 are positioned between first frame section 210 and second frame section 220, perpendicular to first frame section 210 and second frame section 220. First, second, and third legs 230, 232, and 234 may each include multiple sections. For example, first leg 230 includes a first leg section 240, a second leg section 242, a third leg section 244, a fourth leg section 246, a fifth leg section 248, and a sixth leg section 250. Similar to first frame section 210 and second frame section 220, first, second, third, fourth, fifth, and sixth leg sections 240, 242, 244, 246, 248, and 250 include a plurality of laminations (not shown in FIG. 4) assembled to form each section.

Defined between first, second, third, fourth, fifth, and sixth leg sections 240, 242, 244, 246, 248, and 250 are a plurality of gaps. For example, first leg 230 includes gaps 260, 262, 264, 266, and 268. Gaps 270 and 272 are defined between first leg section 240 and first frame section 210, and between sixth leg section 250 and second frame section 220, respectively. Gaps 260, 262, 264, 266, 268, 270, and 272 are included within inductor 200 to, at least in part, set a magnetic reluctance of inductor core 202. Multiple, smaller gaps may be included within each of legs 230, 232, and 234 instead of fewer, larger gaps, to reduce heating effects of magnetic fringing. Conductor winding 204 extends around first leg 230 approximately from gap 270 to gap 272. Second leg 232 and third leg 234 are configured substantially similarly to first leg 230.

Inductor 200 also includes a fringe shield 280. Fringe shield 280 is positioned along an edge 282 of first frame section 210, second frame section 220, and first leg 230. Fringe shield 280 repels magnetic force lines formed between adjacent leg sections that extend across gaps 260, 262, 264, 266, and 268.

Figure 5:
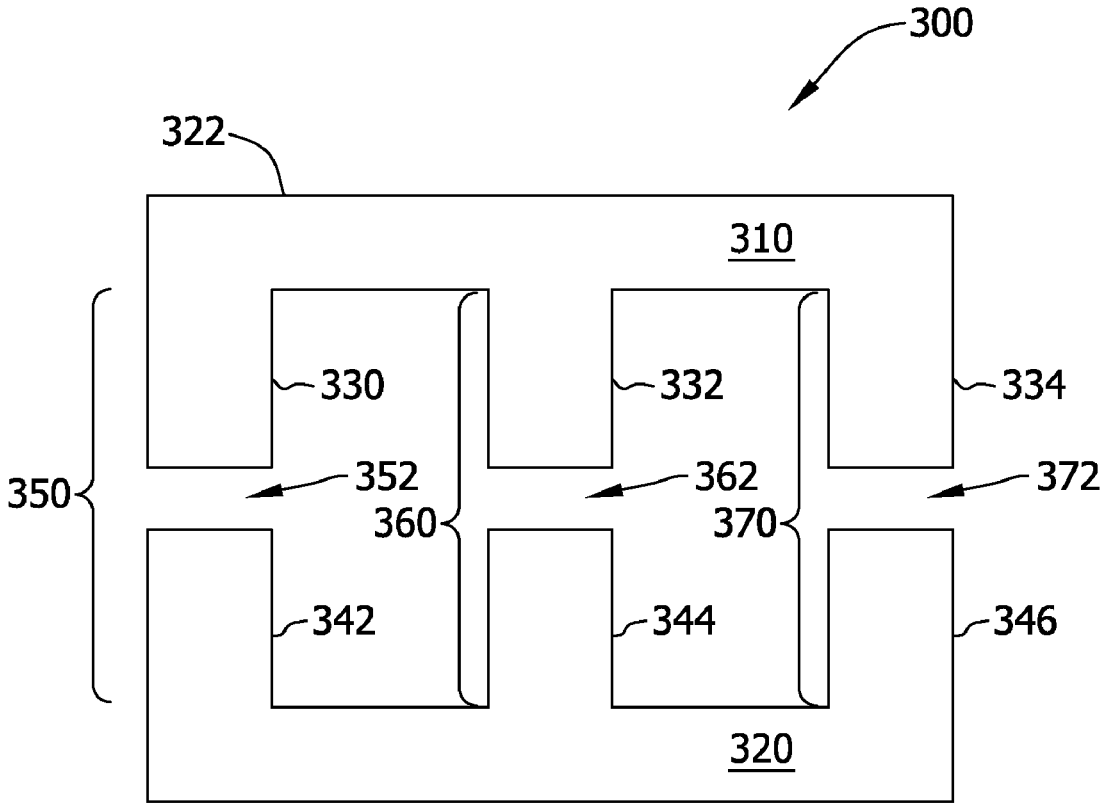
FIG. 5 is a side perspective view of an exemplary embodiment of an inductor core section.

FIG. 5 is a side perspective view of an exemplary embodiment of an inductor core 300. Inductor core 300 includes a first section 310 and a second section 320. In the exemplary embodiment, first section 310 and second section 320 are each "E" shaped core sections. Although described herein as having an "E" shape, inductor core sections 310 and 320 may have any shape that allows inductor 170 (shown in FIG. 3) to function as described herein. In the exemplary embodiment, first section 310 and second section 320 include a plurality of laminations, assembled to form each of sections 310 and 320. In the exemplary embodiment, first section 310 includes an end portion 322. First section 310 also includes a first leg 330, a second leg 332, and a third leg 334, each extending from end portion 322. In the exemplary embodiment, second section 320 includes an end portion 340. Second section 320 also includes a first leg 342, a second leg 344, and a third leg 346, extending from end portion 340.

In the exemplary embodiment, first section 310 and second section 320 are positioned to form inductor core 300. First leg 330 is positioned adjacent to first leg 342 to form a first core leg 350 and a gap 352 defined between first legs 330 and 342. Second leg 332 is positioned adjacent to second leg 344 to form a second core leg 360 and a gap 362 defined between second legs 332 and 344. Third leg 334 is positioned adjacent to third leg 346 to form a third core leg 370 and a gap 372 defined between third legs 334 and 346. Although described herein as including first core leg 350, second core leg 360, and third core leg 370, which may be used in a three-phase inductor, inductor core 300 may include any number of core legs and be used in a single-phase inductor, or multiple-phase inductors.

Figure 6:
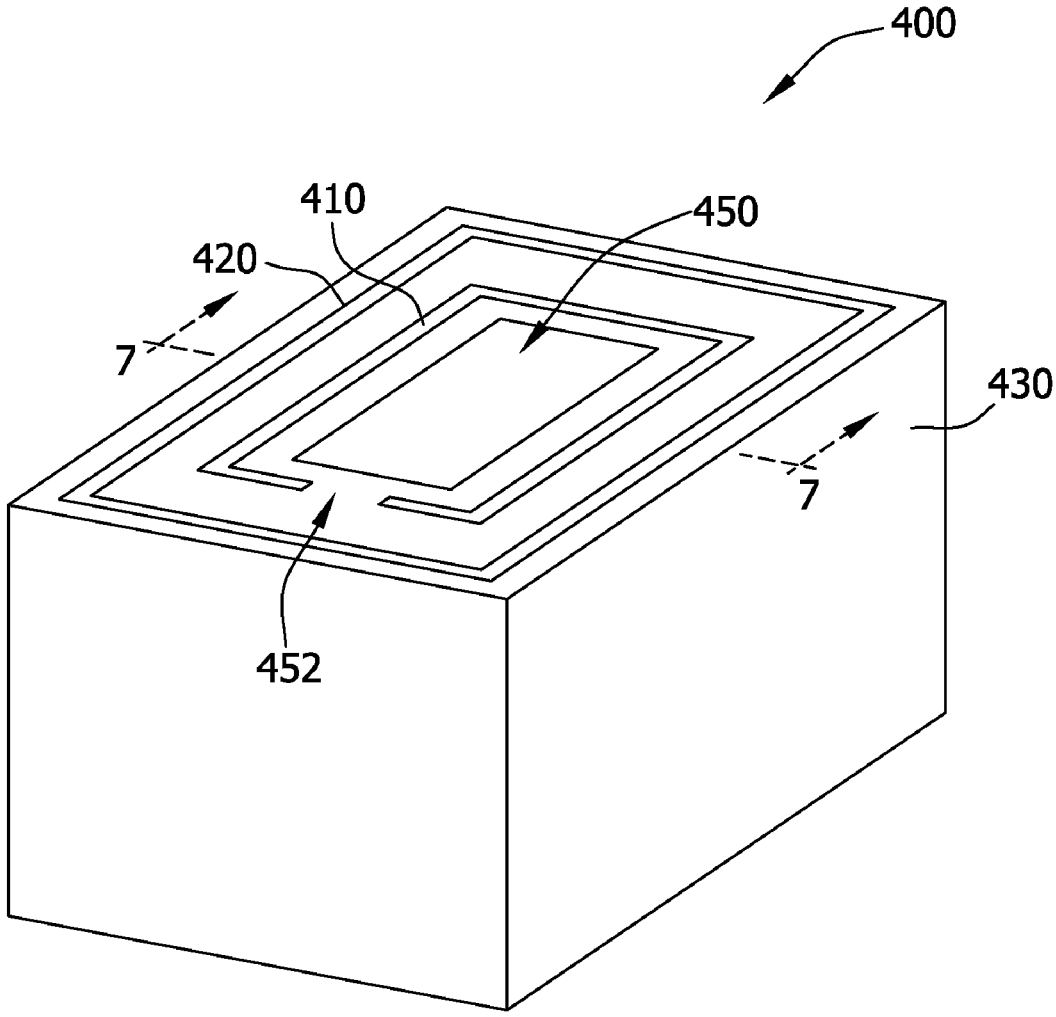
FIG. 6 is a perspective view of an exemplary cast coil and fringe shield assembly.

FIG. 6 is a perspective view of an exemplary cast coil and fringe shield assembly 400. In the exemplary embodiment, cast coil and fringe shield assembly 400 includes a fringe shield 410 and a conductor winding 420 positioned to surround a portion of an inductor core, for example, inductor core leg 350 (shown in FIG. 5). Fringe shield 410 and conductor winding 420 are at least partially encased within an insulating material 430. In an exemplary embodiment, fringe shield 410 and conductor winding 420 are sealed within insulating material 430, such that fringe shield 410 and conductor winding 420 are protected against contamination, for example, but not limited to, moisture, salt, and debris.

In the exemplary embodiment, fringe shield 410 is secured adjacent to conductor winding 420 by insulating material 430. In the exemplary embodiment, cast coil and fringe shield assembly 400 includes an opening 450. In some embodiments, fringe shield 410 includes a non-magnetic material configured to provide magnetic insulation, for example, but not limited to, formed copper. Neither fringe shield 410 nor conductor winding 420 form a closed path around core leg 350 (shown in FIG. 5), in order to prevent an unintentional shorted turn. In the exemplary embodiment, to prevent forming a shorted turn, fringe shield 410 includes a gap 452. Gap 452 may be any size, and positioned anywhere along fringe shield 410 that allows fringe shield 410 to function as described herein.

Figure 7:
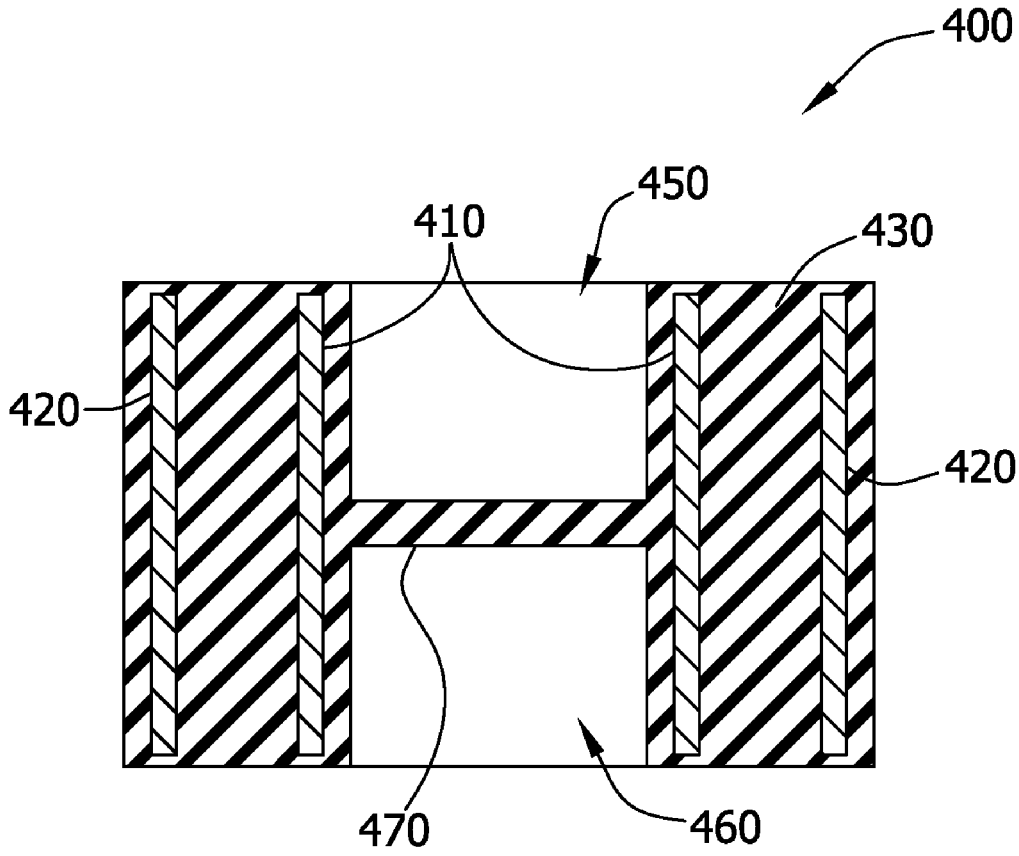
FIG. 7 is a cut-away side view of the cast coil and fringe shield assembly shown in FIG. 6.

FIG. 7 is a cut-away side view of cast coil and fringe shield assembly 400, taken along section 7-7 (shown in FIG. 6). In the exemplary embodiment, fringe shield 410 is secured adjacent to conductor winding 420 by insulating material 430. In the exemplary embodiment, insulating material 430 includes an epoxy material. Although described as an epoxy material, insulating material 430 is not limited to epoxy materials, but may be any suitable insulating material. In some embodiments, fringe shield 410 and conductor winding 420 are positioned within insulating material 430 using a vacuum impregnating process. Cast coil and fringe shield assembly 400 may also be formed using a casting process that includes placing fringe shield 410 and conductor winding 420 into a mold while a void in the mold is filled with insulating material 430. The mold is left undisturbed until cured to the point where cast coil and fringe shield assembly 400 may be safely removed from the mold. In some embodiments, heat is applied to accelerate curing of insulating material 430. In the exemplary embodiment, cast coil and fringe shield assembly 400 includes first opening 450 and a second opening 460. First opening 450 is configured to surround a portion of an inductor core, for example, first leg 330 (shown in FIG. 5). Second opening 460 is configured to surround a portion of an inductor core, for example, first leg 342. In the exemplary embodiment, cast coil and fringe shield assembly 400 includes an insulating section 470 formed from insulating material 430. Insulating section 470 is configured to substantially fill an inductor core gap, for example, gap 352 (shown in FIG. 5).

Figure 8:
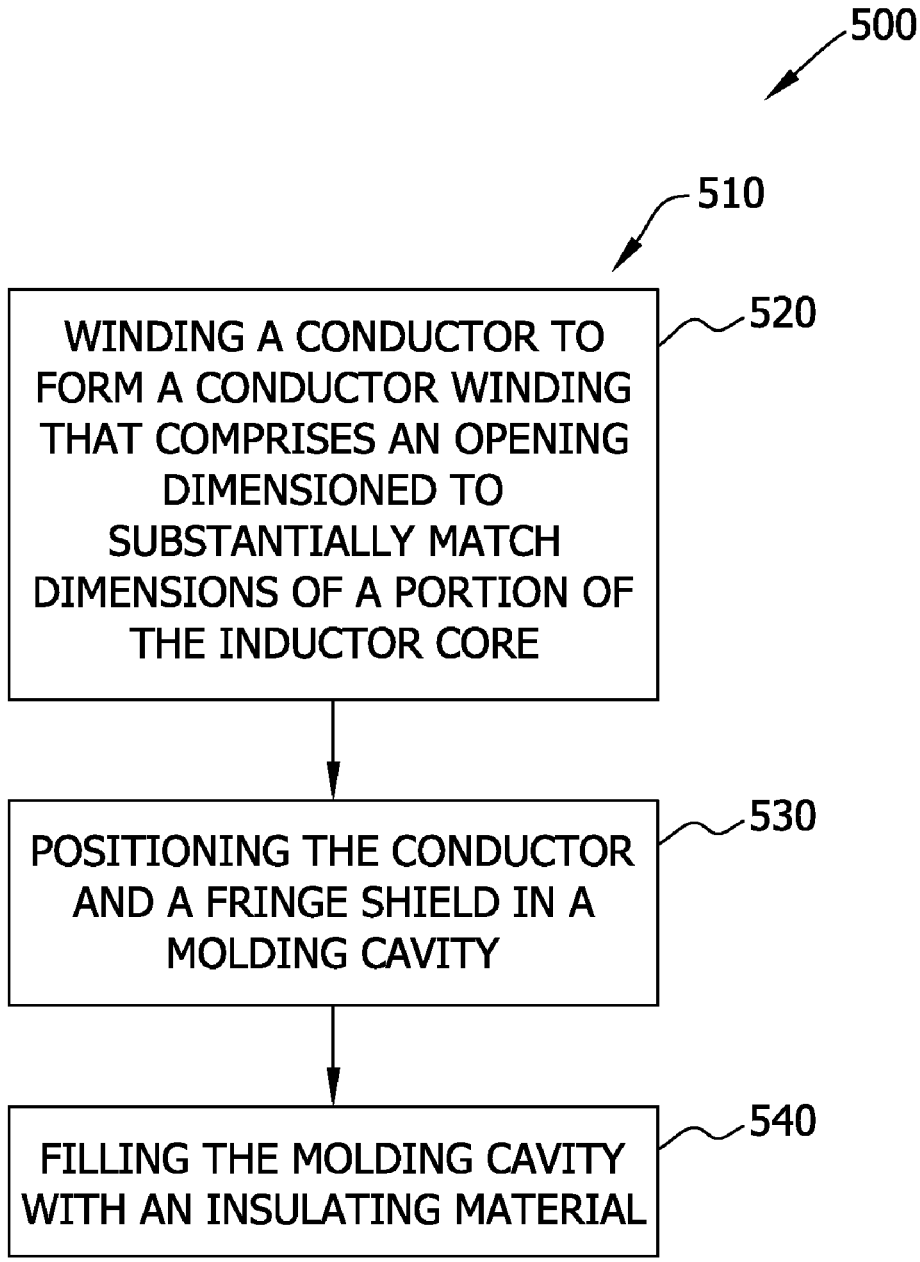
FIG. 8 is a flowchart of an exemplary method for manufacturing a cast coil and fringe shield assembly.

FIG. 8 is a flowchart 500 of an exemplary method 510 for manufacturing a cast coil and fringe shield assembly, for example, cast coil and fringe shield assembly 400 (shown in FIG. 7). Method 510 includes winding 520 a conductor to form a conductor winding, for example, conductor winding 420 (shown in FIG. 6), having an opening dimensioned to substantially match dimensions of a portion of an inductor core, for example, inductor core leg 350 (shown in FIG. 5). In an exemplary embodiment, winding 520 includes winding the conductor around a removable arbor that is dimensioned to substantially match dimensions of inductor core leg 350. Method 510 also includes positioning 530 conductor winding 420 and a fringe shield, for example, fringe shield 410 (shown in FIG. 6), in a molding cavity. Fringe shield 410 is positioned a predetermined distance from an edge of conductor winding 420. Method 510 also includes filling 540 the molding cavity with an insulating material, for example, insulating material 430 (shown in FIG. 6), configured to insulate conductor winding 420 and maintain the position of fringe shield 410 with respect to conductor winding 420.

In some embodiments, filling 540 the molding cavity with insulating material 430 includes a vacuum impregnating process. Although described herein as being molded using a vacuum impregnating process, cast coil and fringe shield apparatus 400 (shown in FIG. 7) may be formed using any other molding or casting process that facilitates production of an assembly that functions as described herein. In some embodiments, filling 540 the molding cavity with insulating material 430 also includes forming an insulating section configured to be positioned within a rotor core gap between portions of the inductor core. More specifically, filling 540 the molding cavity may include forming an insulating section, for example, insulating section 470 (shown in FIG. 7). Casting conductor winding 420 and fringe shield 410 facilitates rigidly locating and securing conductor winding 420 and fringe shield 410. Rigidly locating and securing conductor winding 420 and fringe shield 410 facilitates including a single larger gap (shown in FIG. 5) rather than many smaller gaps (shown in FIG. 4), while controlling heating effects caused by magnetic fringing. Casting conductor winding 420 and fringe shield 410 also facilitates protecting conductor winding 420 from environmental contaminates, for example, but not limited to, moisture, salt, and debris.

The inductor device described above includes a cast coil and fringe shield assembly. The apparatus and methods described herein are not limited to a combined inductor device and cast coil and fringe shield assembly, but rather, the cast coil and fringe shield assembly may be included within other devices, for example, but not limited to, inductors and rotating exciters.

The above-described inductor device and cast coil and fringe shield assembly is highly fault-tolerant and cost-effective. Reducing a number of components forming the inductor core facilitates reducing the failure rate of the inductor. Reducing the number of components forming the inductor core also facilitates increasing the life of the inductor by reducing wear of the components and movement of components relative to one another. Furthermore, reducing the number of components forming the inductor core facilitates reducing assembly complexity, which may reduce the cost of manufacturing the inductor. Casting the conductor winding and fringe shield in a single assembly facilitates maintaining the position of the fringe shield with respect to the conductor winding and the rotor core, which facilitates maintaining a predetermined performance of the fringe shield. Accurately positioning, and maintaining the position of the fringe shield with respect to the conductor winding facilitates use of a larger gap while maintaining control of the heating effects from magnetic fringing. An inductor core having fewer parts, for example, inductor core 300 which includes only first section 310 and second section 320, facilitates reducing potential for damage due to movement of more numerous, smaller parts. As a result, the cast coil and fringe shield assembly is part of a cost-effective and reliable inductor device capable of high-frequency operation.

Exemplary embodiments of apparatus and methods for manufacture of an inductor device are described above in detail. The apparatus and methods are not limited to the specific embodiments described herein, but rather, components of the apparatus and/or steps of the methods may be utilized independently and separately from other components and/or steps described herein. For example, the apparatus and methods are not limited to practice with only the wind turbine described herein. Rather, the exemplary embodiment can be implemented and utilized in connection with many other power generation applications.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An inductor device comprising:

a core comprising two core sections;

at least one gap defined between said two core sections; and at least one cast coil and fringe shield assembly comprising a conductor winding and a fringe shield sealed within an insulator, said insulator including a gap insulating section disposed at least partially within said at least one gap, said at least one cast coil and fringe shield assembly at least partially surrounding a portion of each of said two core sections.

2. An inductor device in accordance with claim 1, wherein said insulator is comprised of an epoxy material.

3. An inductor device in accordance with claim 1, wherein said inductor device is a three-phase inductor device.

4. An inductor device in accordance with claim 1, wherein said two core sections are "E" shaped core sections, each of said "E" shaped core sections comprises an end portion and three legs, said three legs substantially parallel to one another, substantially perpendicular to said end portion, and having substantially equal lengths.

5. An inductor device in accordance with claim 4, wherein said at least one cast coil and fringe shield assembly at least partially surrounds a portion of at least one of said three legs.

6. An inductor device in accordance with claim 1, wherein said fringe shield comprises a non-magnetic material.

7. An inductor device in accordance with claim 1, wherein said fringe shield is configured to facilitate control of magnetic flux created during operation of said inductor device.

8. An inductor device in accordance with claim 1, wherein said fringe shield is positioned adjacent said conductor winding, said two core sections, and said at least one gap defined between said two core sections.

9. A cast coil and fringe shield assembly comprising:

a conductor winding configured to at least partially surround at least one of two inductor core sections;

a fringe shield positioned adjacent said conductor winding; and an insulating material configured to receive a portion of each of said two inductor core sections, the insulating material defining a gap insulating section configured to provide insulation between said two inductor core sections, said fringe shield and said conductor winding disposed within said insulating material.

10. A cast coil and fringe shield assembly in accordance with claim 9, wherein said insulating material comprises an epoxy material.

11. A cast coil and fringe shield assembly in accordance with claim 9, wherein said fringe shield comprises a non-magnetic material configured to provide magnetic insulation.

12. A cast coil and fringe shield assembly in accordance with claim 9, wherein said fringe shield is disposed at least partially within said conductor winding.

13. A cast coil and fringe shield assembly in accordance with claim 9, wherein said insulating material defines a first opening configured to receive said portion of one of said two inductor core sections and a second opening configured to receive said portion of the other of said two inductor core sections.

14. A cast coil and fringe shield assembly in accordance with claim 13, wherein said first and second openings are defined in opposite ends of said cast coil and fringe shield assembly.

15. A method for manufacturing a cast coil and fringe shield assembly, said method comprising:

winding a conductor to form a conductor winding that comprises an opening dimensioned to receive a portion of an inductor core;

positioning the conductor winding and a fringe shield in a molding cavity, the conductor winding spaced apart from the fringe shield; and filling the molding cavity with an insulating material configured to insulate the conductor winding and maintain the position of the fringe shield with respect to the conductor winding; wherein filling the molding cavity with an insulating material further comprises forming an insulating section configured to be positioned within a gap between portions of the inductor core.

16. A method in accordance with claim 15, wherein positioning the conductor winding and the fringe shield in the molding cavity comprises positioning the fringe shield a predetermined distance from at least one edge of the conductor winding.

17. A method in accordance with claim 15, wherein filling the molding cavity with the insulating material comprises a vacuum impregnating process.

18. A method in accordance with claim 15, wherein filling the molding cavity with an insulating material further comprises forming an insulating section configured to be positioned within a gap between portions of the inductor core.

19. A method in accordance with claim 15, wherein filling the molding cavity comprises forming at least one opening in the cast coil and fringe shield assembly configured to receive at least one portion of an inductor core.

* * * * *